US005295383A

United States Patent [19]

Kirii et al.

[11] Patent Number: 5,295,383

[45] Date of Patent: Mar. 22, 1994

[54] HYDRAULIC CUSHIONING SYSTEM FOR PRESS, HAVING SHUT-OFF VALVE FOR DISCONNECTION OF PRESSURE-PIN CYLINDERS FROM POWER SUPPLY UPON CONTACT OF MOVABLE DIE WITH WORKPIECE

[75] Inventors: Kazunari Kirii, Aichi; Tsutomu Ono; Seiki Minami, both of Toyota, all of Japan

[73] Assignee: Toyota Jidosha Kabushiki Kaisha, Aichi, Japan

[21] Appl. No.: 940,369

[22] Filed: Sep. 3, 1992

[30] Foreign Application Priority Data

Sep. 4, 1991 [JP] Japan ..... 3-254823
Apr. 7, 1992 [JP] Japan ..... 4-114087

[51] Int. Cl.[5] ..... B21D 24/02
[52] U.S. Cl. ..... 72/351; 72/453.13
[58] Field of Search ..... 72/20, 351, 453.13; 100/259; 267/119

[56] References Cited

U.S. PATENT DOCUMENTS

| | | | |
|---|---|---|---|
| 3,290,034 | 12/1966 | Williamson | 72/453.13 |
| 3,914,978 | 10/1975 | Sekanina et al. | 72/465 |
| 4,056,965 | 11/1977 | Heiser | 72/351 |
| 4,635,466 | 1/1987 | Seki et al. | 72/351 |
| 4,669,298 | 6/1987 | Kono et al. | 72/453.13 |
| 5,065,606 | 11/1991 | Kadis | 72/351 |

FOREIGN PATENT DOCUMENTS

| | | |
|---|---|---|
| 0365317 | 4/1990 | European Pat. Off. . |
| 1188143 | 9/1959 | France . |
| 63-34753 | 9/1988 | Japan . |
| 1-60721 | 4/1989 | Japan . |
| 2-39622 | 10/1990 | Japan . |
| 3-24245 | 5/1991 | Japan . |
| 357328 | 9/1931 | United Kingdom . |

OTHER PUBLICATIONS

Patent Abstracts of Japan, vol. 12, No. 286 (M-727) (3133) Aug. 5, 1988.

Energie Fluide, vol. 13, No. 67, Jan. 1974, Paris, FR "Les techniques d'emboutissage sont ameliorees par l'emploi de l'hydraulique", pp. 41–42.

EPO Search Report dated Dec. 17, 1992.

*Primary Examiner*—Lowell A. Larson
*Assistant Examiner*—Thomas C. Schoeffler
*Attorney, Agent, or Firm*—Finnegan, Henderson, Farabow, Garrett & Dunner

[57] ABSTRACT

A hydraulic cushioning apparatus for a press, having work-supporting pressure pins, hydraulic cylinders linked with the pressure pins, and a fluid passage connecting a hydraulic power supply to the hydraulic cylinders, to apply a preset hydraulic pressure to the cylinders. The apparatus includes a shut-off valve disposed in the fluid passage for connection and disconnection of the hydraulic power supply to and from the hydraulic cylinders, and a controller for controlling the shut-off valve such that the shut-off valve is closed before a movable die of the press comes into pressing contact with the workpiece, and is held in the closed position for at least a period which expires when the fluid in the hydraulic cylinders rises to the preset pressure level.

13 Claims, 4 Drawing Sheets

HYDRAULIC CUSHIONING SYSTEM FOR PRESS, HAVING SHUT-OFF VALVE FOR DISCONNECTION OF PRESSURE-PIN CYLINDERS FROM POWER SUPPLY UPON CONTACT OF MOVABLE DIE WITH WORKPIECE

BACKGROUND OF THE INVENTION

1. Field of the Invention

The present invention relates in general to a hydraulic cushioning apparatus for a press, and more particularly to a hydraulic system which includes hydraulic cylinders linked with respective pressure pins or cushion pins for supporting a workpiece through a pressure pad.

2. Discussion of the Prior Art

Such a hydraulic cushioning apparatus is known, according to laid-open Publication Nos. 2-39622 and 1-60721 of Japanese Utility Model Applications, for example.

The basic arrangement of the hydraulic cushioning apparatus disclosed in the above-identified publications is illustrated in FIG. 4, wherein the cushioning apparatus includes a pressure pad in the form of a cushioning ring 6 disposed adjacent to a lower die 3 of a press. The cushioning ring 6 is supported by a plurality of pressure pins 7 such that the top surface of the ring 6 is substantially flush with the top surface of the lower die 3, so that a workpiece W in the form of a metal strip placed on the ring 6 is protected against wrinkling when the lower die 3 cooperates with an upper movable die 1 to perform a pressing action on the workpiece W.

The cushioning apparatus further includes hydraulic cylinders 8 corresponding to the pressure pins 7. Each of these cylinders 8 has a cylindrical wall 8*a* linked with a pneumatically operated die cushioning device 9, through a cushion platen 10. Each hydraulic cylinder 8 also has a piston 8*b* fixed to the lower end of the corresponding pressure pin 7 remote from the cushioning ring 6. The cylindrical wall 8*a* and the piston 8*b* cooperate to define a fluid chamber, and the fluid chambers of the cylinders 8 are connected to a common manifold 15, which in turn is connected to a hydraulic power supply 20 via a flexible tube 16 and a check valve 21. The check valve 21 permits a flow of a working fluid in the direction from the hydraulic power supply 20 toward the hydraulic cylinders 8, and inhibits a flow of the fluid in the reverse direction.

The hydraulic power supply 20 is adapted to provide the pressurized fluid having a preset pressure level, so that the fluid is supplied through the check valve 21 and manifold 15 to the hydraulic cylinders 8 when the pressure in the cylinders 8 falls below the preset level. Thus, the pressure in the cylinders 8 is maintained at the preset level. It is noted that the check valve 21 prevents the fluid from flowing from the hydraulic cylinders 8 back to the hydraulic power supply 20, even when the pressure in the cylinders 8 rises above the preset level (preload level) when the upper movable die 1 is moved down to force the workpiece W against the lower die 3 and the pressure pad in the form of the cushioning ring 6, during a pressing cycle in which the movable die 1 is reciprocated between an upper stroke end and a lower stroke end, by a suitable drive mechanism.

According to the hydraulic cushioning apparatus constructed as described above, the cushioning pressures of the pressure pins 7 which act on the cushioning ring 6 can be made substantially equal to each other, thereby assuring a pressing operation with high precision, with a uniform cushioning force exerted on the cushioning ring 6 and the workpiece W over the entire working area.

The die cushioning device 9 uses an air cylinder 11 which supports the pressure platen 10 and which is supplied with a pressurized air from a pneumatic pressure source 12, through an air regulator 13 and an air tank 14, as well known in the art.

However, the known hydraulic cushioning apparatus suffers from the following problem. Namely, the pressure pins 7 are subject to an abrupt increase in the load upon collision of the movable die 1 against the workpiece W, during the downward movement of the die 1. The increased load or impact force received by the pressure pins 7 are transmitted to the die cushioning device 9 through the hydraulic cylinders 8.

Generally, the air pressure in the air cylinder 11 and the hydraulic pressure in the hydraulic cylinders 8 upon colliding contact of the upper movable die 1 with the workpiece W are such that the pressure platen 10 is instantaneously lowered due to the impact force indicated above, with the cylindrical walls 8*a* being lowered a greater distance than the pistons 8*b* which are lowered with the pressure pins 7. This results in a temporary increase in the volume of the fluid chamber of each hydraulic cylinder 8, whereby the fluid pressure in the fluid chamber is lowered below the preset level, so that the pressurized fluid is fed instantaneously from the hydraulic power supply 20 into the hydraulic cylinders 8 until the pressure in the cylinders 8 rises to the preset level of the power supply 20. This phenomenon, so-called "pumping action", causes the pressure in the cylinders 8 to be higher than the preset level when the upper movable die 1 returns to the upper stroke end, that is, when the pressing cycle involving a reciprocation of the die 1 between the upper and lower stroke ends is completed.

With the "pumping action" repeated with the pressing cycles, the pressure in the hydraulic cylinders 8 at the beginning of each pressing cycle gradually increases from the preset level, causing considerable deterioration of the cushioning function of the cylinders 8 and its function of compensation for possible variation in the length of the pressure pins 7, and eventually leading to leakage of the fluid from the cylinders 8 and/or damaging of the cylinders or other troubles with the hydraulic system.

SUMMARY OF THE INVENTION

It is therefore an object of the present invention to provide a hydraulic cushioning apparatus for a press, which include hydraulic cylinders linked with respective pressure pins, and which is capable of maintaining, with high reliability, the fluid pressure in the hydraulic cylinders at a desired level preset by a hydraulic power supply.

The above object may be achieved according to the principle of the present invention, which provides a hydraulic cushioning apparatus for a press having a movable die, including a pressure pin associated with a workpiece, a hydraulic cylinder linked with the pressure pin, respectively, a cushioning device linked with the hydraulic cylinder, a hydraulic power supply for supplying a pressurized fluid at a preset pressure level to the hydraulic cylinder, and fluid passage means for hydraulically connecting the hydraulic power supply and the hydraulic cylinder, the apparatus comprising: (a) a check valve disposed in the fluid passage means, the check valve permitting a flow of the pressurized fluid from the hydraulic power supply to the hydraulic cylinder, a shut-off valve disposed in the fluid passage means, in series connection with the check valve, and having an open position and a closed position for connection and disconnection of the hydraulic power supply to and from the hydraulic cylinder, respectively; and (b) control means connected to the shut-off valve, for controlling the shut-off valve such that the shut-off valve is operated from the open position to the closed position to inhibit a flow of the fluid from the hydraulic power supply line into the hydraulic cylinder before the movable die comes into pressing contact with the workpiece, and is held in the closed position for at least a period until a pressure of the fluid in the hydraulic cylinder rises to the preset pressure level, thereby preventing an increase in the pressure in the hydraulic cylinder above the preset level due to a flow of the fluid into the hydraulic cylinder when the pressure is lower than the preset level.

In the hydraulic cushioning apparatus of the present invention constructed as described above, the control means is adapted such that the shut-off valve is closed a suitable time before the movable die is brought into pressing or colliding contact with the workpiece, so as to disconnect the hydraulic cylinders from the hydraulic power supply. The shut-off valve is held in the closed position until the pressure in the hydraulic cylinders, which is once lowered upon the pressing contact of the movable die with the workpiece, rises to the preset level. The present arrangement prevents the pressurized fluid from being fed into the hydraulic cylinders even when the pressure in the hydraulic cylinders is temporarily lowered below the preset level, due to the collision of the movable die against the workpiece. Consequently, the pressure in the hydraulic cylinders will not increase as the pressing cycle is repeated.

When the pressure in the hydraulic cylinders rises to the preset level, the shut-off valve is opened to permit fluid communication between the hydraulic cylinders and the hydraulic power supply, so that the pressurized fluid may flow into the hydraulic cylinders if the pressure in the hydraulic cylinders is lower than the preset level. Thus, the present hydraulic cushioning apparatus permits the pressure in the cylinders to be maintained at the preset level, and prevents otherwise possible troubles such as the deterioration of the cushioning function of the hydraulic cylinders, leakage of the fluid therefrom and physical damaging of the hydraulic system.

According to a preferred arrangement of the hydraulic cushioning apparatus, the hydraulic power supply includes a hydraulic pressure source for delivering the pressurizing fluid, and a reservoir for receiving the fluid released from the hydraulic cylinders, while the fluid passage means comprises a first fluid passage which connects the hydraulic pressure source and the hydraulic cylinders through the above-indicated shut-off valve, and which includes a check valve disposed between the hydraulic pressure source and the shut-off valve. The check valve permits a flow of the fluid in the direction from the hydraulic pressure source toward the hydraulic cylinders and inhibits a flow of the fluid in the reverse direction. The fluid passage means further comprises a second fluid passage which connects the reservoir and a portion of the first fluid passage between the check valve and the shut-off valve.

In the preferred arrangement indicated above, it is desirable to provide a second shut-off valve provided in the second fluid passage, in addition to the shut-off valve provided as a first shut-off valve in the first fluid passage. In this case, the control means is further adapted to control the second shut-off valve such that the second shut-off valve is opened after the movable die has started an upward movement from its lower stroke end during each pressing cycle in which the movable die is reciprocated between its upper and lower stroke ends. The control means is further adapted to hold the second shut-off valve open for a period between a moment after the movable die has reached the lower stroke end, and a moment before the first shut-off valve is operated to the closed position.

According to the above arrangement using the second shut-off valve provided in the second fluid passage, as well as the first shut-off valve provided in the first fluid passage, the second shut-off valve is held open for a suitable period of time after the upward movement of the movable die from the lower stroke end has been started, and before the first shut-off valve is closed for the next pressing cycle. During this period, the fluid is returned from the hydraulic cylinders to the reservoir through the second fluid passage and the open second shut-off valve, whereby the pressure in the hydraulic cylinders is lowered below the preset level of the hydraulic pressure source. As a result, the pressurized fluid having the preset level is delivered from the hydraulic pressure source to the hydraulic cylinders, so that the pressure in the hydraulic cylinders is eventually maintained at the preset level. Since the fluid flows between the hydraulic cylinders and the pressure source and reservoir through the second and first shut-off valves both in the open position are effected as described above, for each pressing cycle, it is possible to suitably avoid an increase of the pressure in the hydraulic cylinders due to a rise in the temperature of the working fluid in the hydraulic cylinders at the start of the pressing cycle, which may cause damaging of the hydraulic cylinders. Thus, the present preferred arrangement assures reliable pressing operations and improved quality of products obtained. In this respect, it is noted that the temperature of the fluid in the hydraulic cylinders and the manifold connecting these cylinders tends to rise due to external factors such as a rise in the ambient temperature and dissipation of heat generated by the dies of the press. Consequently, the temperature of the fluid in the cylinders at the start of each pressing cycle gradually rises as the pressing cycle is repeated. This causes the same problem as caused by the "pumping action" mentioned above.

BRIEF DESCRIPTION OF THE DRAWINGS

The above and optional objects, features and advantages of the present invention will be better understood by reading the following detailed description of presently preferred embodiments of the invention, when considered in connection with the accompanying drawings, in which.

DETAILED DESCRIPTION OF THE PREFERRED EMBODIMENTS

Figure 1:
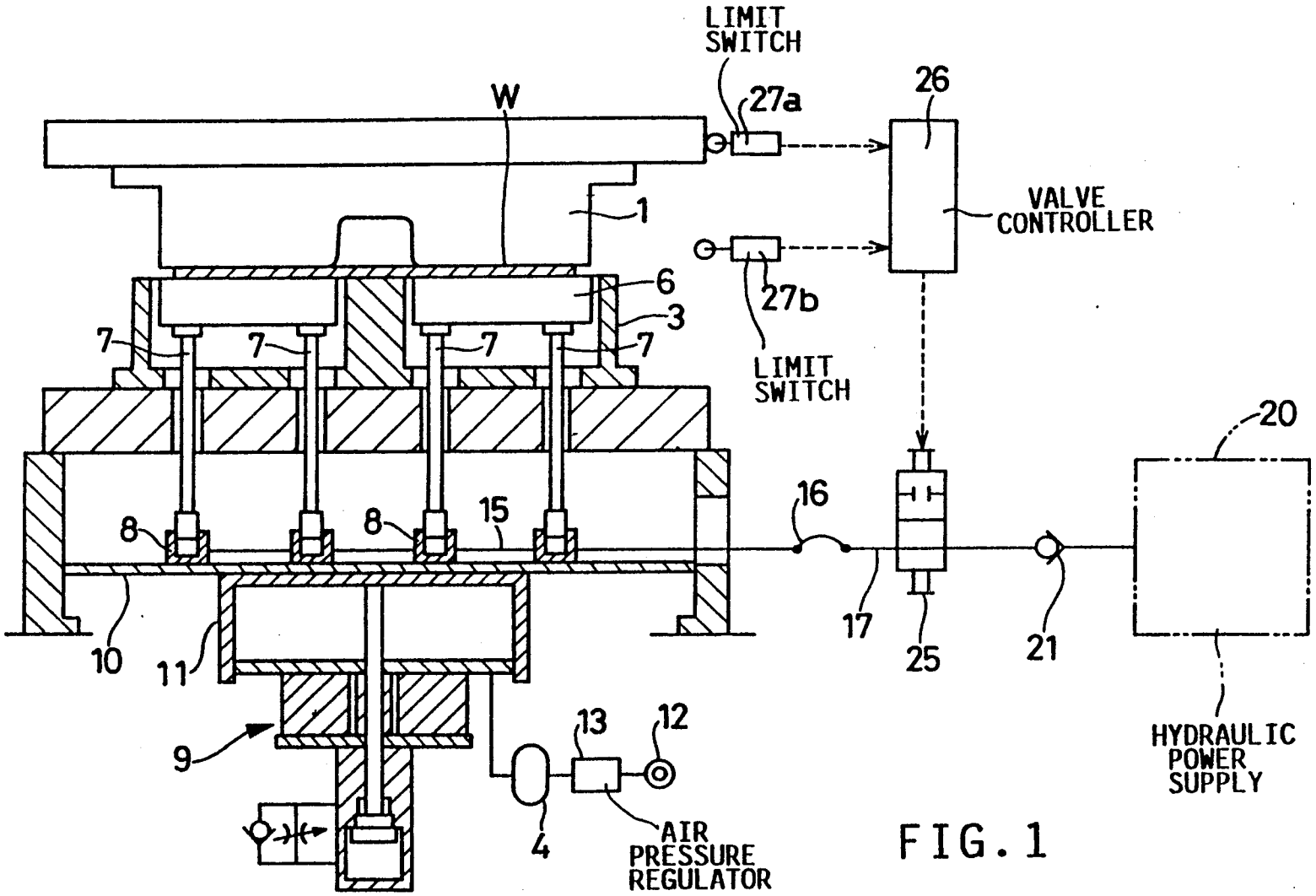
FIG. 1 is a view illustrating one embodiment of a hydraulic cushioning apparatus of the present invention for a press, including pressure pins and corresponding cushioning hydraulic cylinders which are incorporated in the die assembly of the press shown in cross section.
Figure 4:
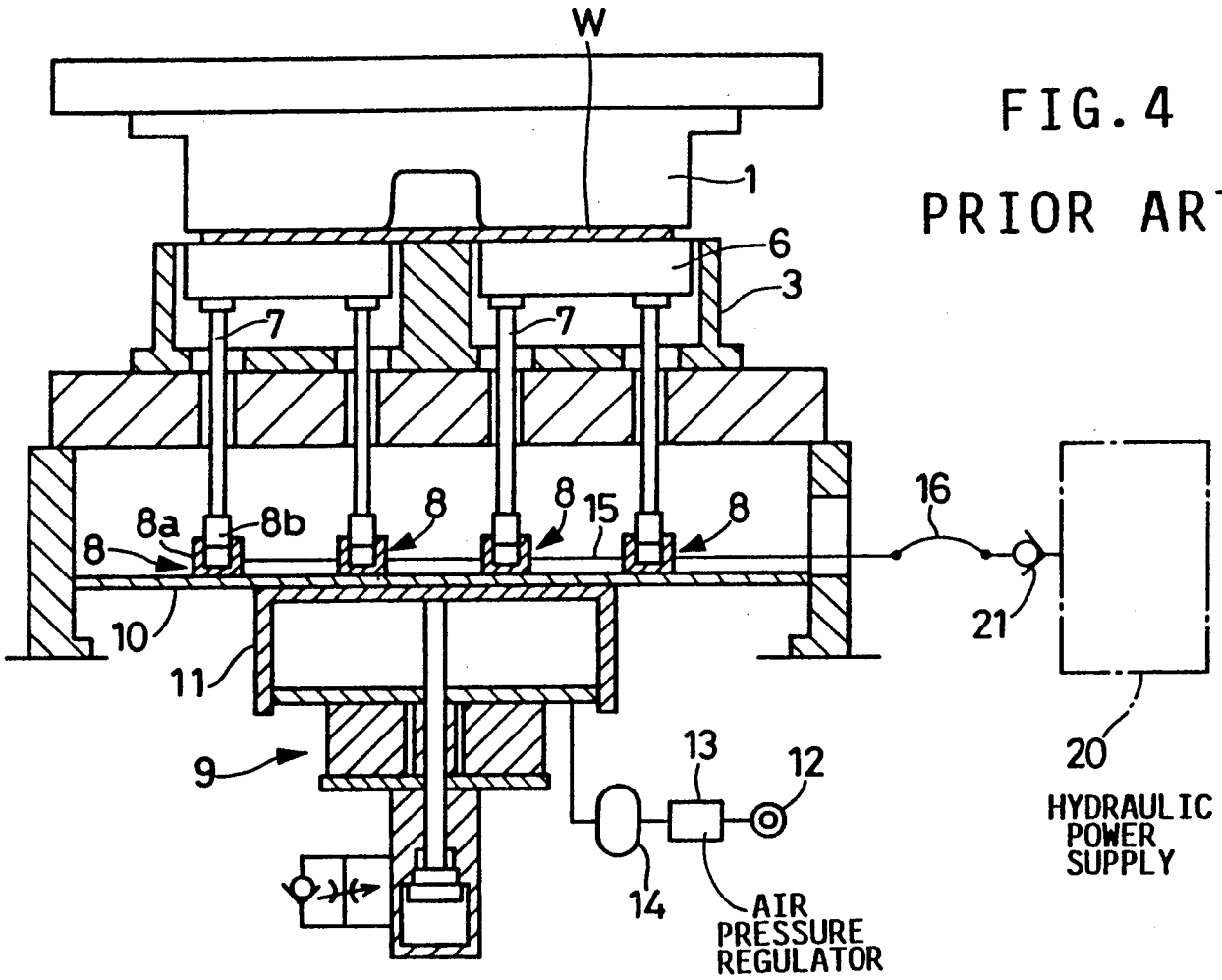
FIG. 4 PRIOR ART
FIG. 4 is a view showing a known hydraulic cushioning apparatus.

Referring first to FIG. 1, the hydraulic cushioning apparatus shown therein is identical with the known apparatus of FIG. 4, except for: limit switches 27*a*, 27*b* provided on a press; an external valve controller 26; and an external part of the hydraulic system to the right of the flexible tube 16, as seen in FIG. 1. The same reference numerals as used in FIG. 4 are used to identify the corresponding components, which have been described by reference to FIG. 4. Redundant descriptions of these components will not be provided in the interest of brevity.

The manifold 15 connecting the hydraulic cylinders 8 is connected to the hydraulic power supply 20, through a fluid passage 17, which includes the flexible tube 16. In a portion of the fluid passage 17 between the flexible tube 16 and the check valve 21, there is provided a solenoid-operated shut-off valve 25, which is a two-port two-position valve. The shut-off valve 25 has an open position for connection of the hydraulic power supply 20 to the hydraulic cylinders 8, and a closed position for disconnection of the power supply 20 from the cylinders 8.

The hydraulic cushioning apparatus is provided with position sensing means in the form of two limit switches 27*a*, 27*b* which are fixed at suitable positions on the body of the press. The limit switch 27*a* is adapted to detect a position of the upper movable die 1 a suitable distance above a position at which the movable die 1 comes into pressing contact with the workpiece W. On the other hand, the limit switch 27*b* is adapted to detect the lower stroke end of the movable die 1. As well known in the art, the movable die 1 is driven by a crankshaft, so that the die 1 is reciprocated between its upper and lower stroke ends indicated at A and B, respectively, in FIG. 3.

Output signals indicative of the operating states of these limit switches 27*a*, 27*b* are applied to a controller 26, which is a sequence controller having a stored program for controlling the shut-off valve 25, depending upon the outputs received from the limit switches 27*a*, 27*b*. That is, the shut-off valve 25 is opened and closed depending upon the position of the movable die 1 during its reciprocation in each pressing cycle, as described below in detail.

Figure 3:
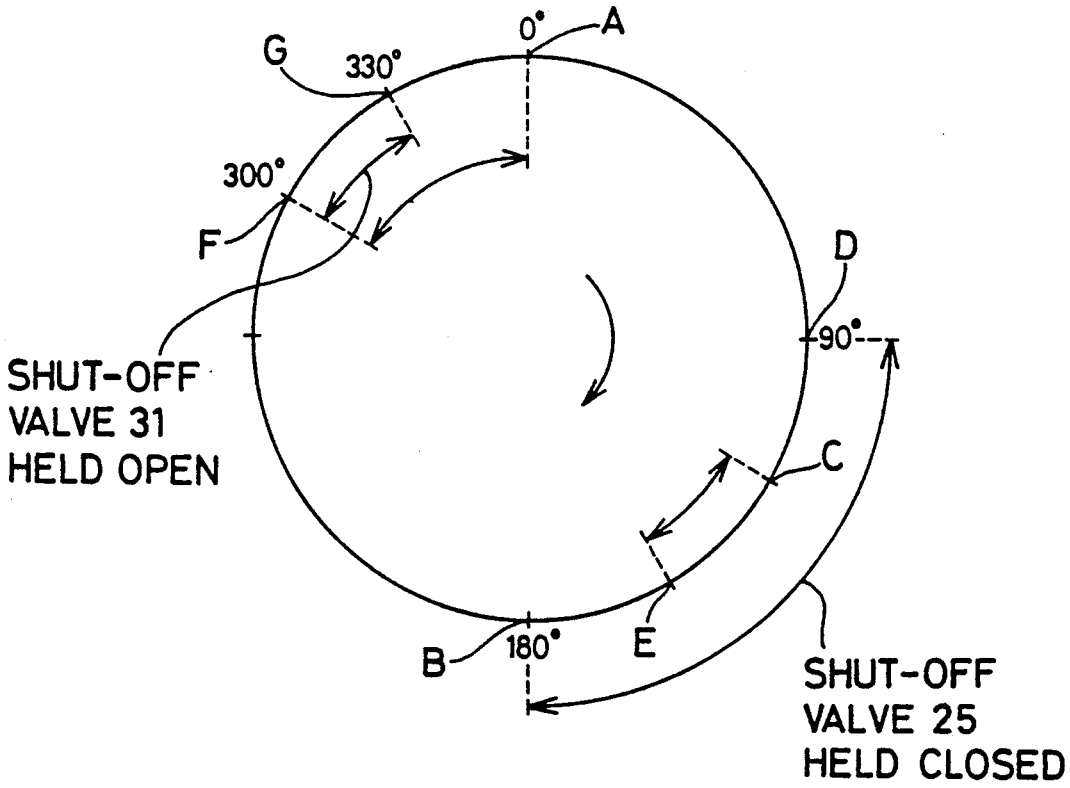
FIG. 3 is a view for explaining operations of first and second shut-off valves used in the embodiment of FIG. 2, in relation to several positions of an upper movable die corresponding to angular positions of a crankshaft for driving the movable die.

Referring to FIG. 3, several positions of the movable die 1 are shown as corresponding to the angular positions of the crankshaft. In each pressing cycle, the movable die 1 is first moved downward from the upper stroke end A (angular position 0° of the crankshaft) to the lower stroke end B (angular position 180° of the crankshaft). In this downward movement, the movable die 1 comes into colliding or pressing contact with the workpiece W, at position C between the positions A and B. Position D (angular position 90° of the crankshaft) of the movable die 1, which is some distance above the die-work contact position C, is detected by the limit switch 27*a*, and the appropriate signal is fed to the controller 26. Further, the lower stroke end B is detected by the limit switch 27*b*, and the appropriate signal is fed to the controller 26.

When the movable die 1 has reached the position D the controller 26 commands the solenoid-operated shut-off valve 25 to be operated to the closed position, according to the output signal received from the limit switch 27*a*. The shut-off valve 25 is held in the closed position until the movable die has reached the lower stroke end B, namely, until the signal from the limit switch 27*b* is received by the controller 26. Thus, the fluid passage 17 is disconnected by the shut-off valve 25, or the hydraulic cylinders 8 are disconnected from the hydraulic power supply 20 by the closed shut-off valve 25, some time before the movable die 1 contacts the workpiece W, and until the die 1 has reached the lower stroke end B.

When the movable die 1 has reached the lower stroke end B, the shut-off valve 25 is operated to the open position. At this time, the pressure in the hydraulic cylinders 8 is higher than the preset pressure level of the power supply 20. Namely, the pressure in the hydraulic cylinders 8 begins to be instantaneously lowered from the preset level, at the die-work contact position C, for the reason indicated above. The pressure in the cylinders 8 then rises back to the preset level, by the time when the movable die 1 has reached position E some distance above the lower stroke end B, as indicated in FIG. 3. Therefore, the limit switch 27*b* may be adapted to detect a position some distance below the position E of the die 1 in the downward movement, or a position some distance above the lower stroke end B in the upward movement.

Although the output signal from the limit switch 27*a* is received by the controller 26 when the movable die 1 passes the position D in the upward direction during the upward movement to the upper stroke end A, the controller 26 is adapted so as not to command the shut-off valve 25 to be closed.

The function of the shut-off valve 25 will be described.

When the movable die 1 is in its upper stroke end A, the shut-off valve 25 is placed in the open position, permitting fluid communication between the hydraulic power supply 20 and the hydraulic cylinders 8. Consequently, the pressurized fluid of the preset pressure level is fed to the hydraulic cylinders 8 if the pressure in the cylinders 8 at this time is lower than the preset level. Thus, the pressure in the cylinders 8 at the beginning of each pressing cycle is maintained at the preset level.

As the crankshaft to move the movable die 1 is rotated, the movable die 1 is lowered from the upper stroke end A, and reaches the position D some distance above the die-work contact position C, whereby this position D is detected by the limit switch 27*a*, and the signal is fed from the switch 27*a* to the controller 26. In response to this signal, the controller 26 commands the shut-off valve 25 to be operated to the closed position, and holds the valve 25 in the closed position until the signal from the limit switch 27*b* is received, that is, until the movable die 1 has reached the lower stroke end B. Therefore, even if the pressure in the hydraulic cylinders 8 is lowered below the preset level of the power supply 20, the fluid cannot be fed into the hydraulic cylinders 8, during the period corresponding to the movement of the die 1 between the positions D and B.

When the movable die 1 has reached the lower stroke end B, the limit switch 27*b* is activated, and the signal is fed to the controller 26, whereby the shut-off valve 25 is returned to the open position for fluid communication between the cylinders 8 and the power supply 20. The shut-off vale 25 is held in the open position until the movable die 1 has reached the position D during the downward movement in the next pressing cycle, following the upward movement back to the upper stroke end A in the present pressing cycle.

It will be understood that the present hydraulic cushioning apparatus is adapted to disconnect the hydraulic cylinders 8 from the hydraulic power supply 20, for at least a period during which the pressure in the cylinders 8 is lower than the preset level due to the impact force transmitted from the movable die 1 to the cylinders 8 through the workpiece W, pressure ring 6 and pressure pins 7.

In the present cushioning apparatus using the shut-off valve 25, therefore, the fluid will not be supplied to the hydraulic cylinders 8 while the pressure in the cylinders 8 is lower than the preset level after the die 1 has collided against the workpiece W. Thus, the shut-off valve 25 prevents otherwise possible gradual increase in the pressure in the cylinders 8 at the beginning of each pressing cycle, thereby avoiding the deterioration of the cushioning function of the hydraulic cylinders and thus assuring reliable pressing operations to obtain pressings without wrinkle, crack or deformation. Further, the present arrangement is effective to prevent leakage of the fluid from the cylinders 8, and damaging of the cylinders, which are encountered on the known apparatus of FIG. 4.

Since the pressure in the hydraulic cylinders 8 at the start of each pressing cycle is held constant, without a variation between different cycles, the products obtained have consistent quality.

Figure 2:
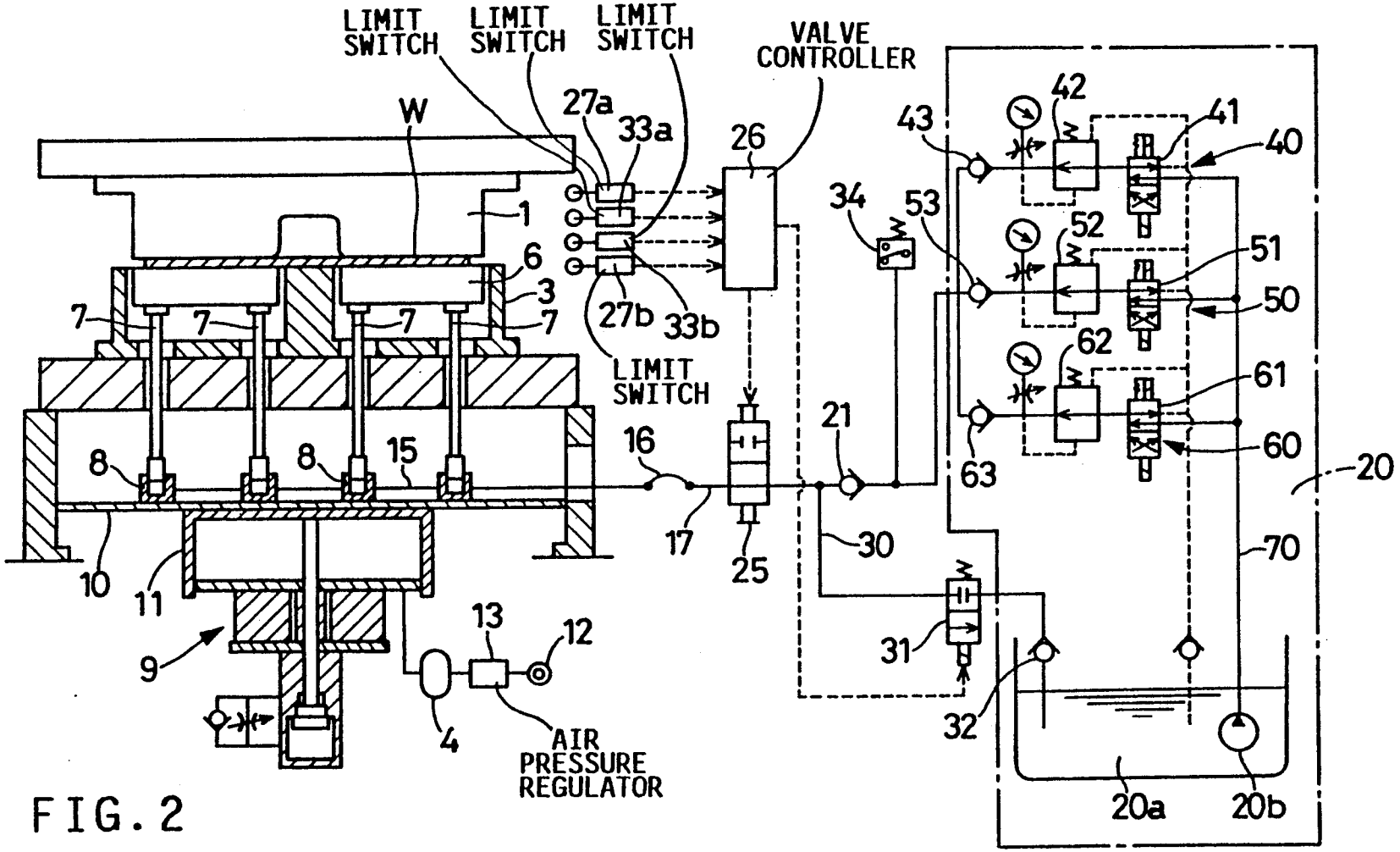
FIG. 2 is a view illustrating another embodiment of the present invention.

Referring next to FIG. 2, there will be described a second embodiment of this invention, which is also provided with the shut-off valve 25, limit switches 27*a*, 27*b* and controller 26, to achieve the same function as described above with respect to the first embodiment of FIG. 1.

The present second embodiment is further provided with a second shut-off valve 31 in a second fluid passage 30, in addition to the shut-off valve 25 provided as the first shut-off valve in the first fluid passage 17. The second fluid passage 30 connects a reservoir 20*a* of the power supply 20 to a portion of the first fluid passage 17 between the first shut-off vale 25 and the check valve 21. A check valve 32 is provided between the second shut-off valve 31 and the reservoir 20*a*. This check valve 32 permits the fluid flow in the direction from the first fluid passage 17 toward the reservoir 20*a*, and inhibits the fluid flow in the reverse direction.

Like the first shut-off valve 25, the second shut-off valve 31 is a solenoid-operated two-port two-position valve electrically connected to the controller 26. In the present embodiment, two additional limit switches 33*a*, 33*b* are provided on the body of the press, to detect two positions of the movable die 1 in the upward movement of the die 1, as described below. The controller 26 controls the second shut-off valve 31 depending upon the output signals received from those limit switches 33*a*, 33*b*, as also described below in detail.

In the present embodiment, a pressure switch 34 is connected to the first fluid passage 17, to detect the pressure in the fluid passage 17, i.e., the pressure in the hydraulic cylinders 8. The pressure switch 34 is turned off if the pressure in the hydraulic cylinders 8 falls below a predetermined lower limit, e.g., 15kg/cm$^2$. That is, the signal from the pressure switch 34 is used to stop the operation of the press, in the event of an abnormal pressure drop in the cylinders 8, due to a certain trouble with the hydraulic system. Usually, the pressure in the cylinders 8 is higher than 20kg/cm$^2$, for example, and the pressure switch 34 is in the on state, permitting an operation of the press.

The hydraulic power supply 20 which includes the reservoir 20*a*, also includes a hydraulic pressure source in the form of a hydraulic pump 20*b*, which delivers the pressurized fluid to a first, a second and a third pre-load pressure setting circuit 40, 50, 60, which provide three different preset pressure levels, e.g., 25kg/cm$^2$, 50kg/cm$^2$ and 75kg/cm$^2$, respectively. Since the understanding of these circuits 40, 50, 60 is not essential to the understanding of the present invention, the circuits will be briefly described. Each of the circuits 40, 50, 60 includes a solenoid-operated four-port two-position shut-off valve 41, 51, 61, a pressure regulator 42, 52, 62 connected to the output port of the corresponding shut-off valve 41, 51, 61, and a check valve 43, 53, 63 connected to the output of the corresponding regulator 42, 52, 62. The check valves 43, 53, 63 permit the fluid flow only in the direction from the power supply 20 toward the hydraulic cylinders 8.

The input port of each shut-off valve 41, 51, 61 is connected to a conduit 70, which in turn is connected to the pump 20*b*. The pump 20*b* has a rating to deliver the pressurized fluid of at least 75kg/cm$^2$. One of the three different preset pressure levels is selected by the shut-off valves 40, 50, 60.

Referring again to FIG. 3, the movable die 1 is moved upward after the downward pressing action. When the die 1 reaches position F (angular position 300° of the crankshaft) some distance below the upper stroke end A, the limit switch 33*b* is turned on, and the appropriate signal is fed to the controller 26, whereby the second shut-off valve 31 is opened permitting fluid communication between the hydraulic cylinders 8 and the reservoir 20*a* of the power supply 20, through the second fluid passage 30, and the first fluid passage 17 and the first shut-off valve 25 which is now in the open position. Consequently, the fluid in the cylinders 8 and manifold 15 flows toward the reservoir 20*a*, through the first and second fluid passages 17, 30 and the open shut-off valves 25, 31, whereby the pressure in the cylinders 8 is gradually lowered.

After the pressure in the cylinders 8 falls below the currently selected preset level, the pressurized fluid of the preset level is supplied to the cylinders 8 from the power supply 20, through the first fluid passage 17, since the first shut-off valve 25 is currently placed in the open position. Accordingly, the pressure in the cylinders 8 again rises to the selected preset level. Thus, a portion of the fluid in a portion of the hydraulic system including the hydraulic cylinders 8 is returned to the reservoir 20*a* through the second fluid passage 30, while the corresponding mass of the fluid is fed toward the cylinders 8 from the power supply 20 through the first fluid passage 17. Thus, the pressure in the cylinders 8 at the beginning of each pressing cycle is set to the selected preset level.

When the movable die 1 has reached position G (angular position 330° of the crankshaft) some distance above the position F, the limit switch 33*a* is turned on, and the appropriate signal is fed to the controller 26. In response to this signal, the controller 26 commands the second shut-off valve 31 to be operated to the closed position, thereby disconnecting the second fluid passage 30 and thus disconnecting the cylinders 8 from the reservoir 20*a*, whereby the pressure in the cylinders 8 is maintained at the selected preset level.

It is noted that after the die 1 has reached the position F, the signal from the pressure switch 34 is made ineffective, so as to prevent stopping of the pressing operation of the press, even though the pressure in the cylinders 8 is lower than the predetermined lower limit (e.g., 15 kg/cm$^2$). That is, the movable die 1 continues to move up to the upper stroke end A, even if the pressure in the cylinders 8 is lower than the lower limit.

The controller 26 is adapted such that the signal of the pressure switch 34 is held ineffective until the die 1 has returned to the upper stroke end A, namely, even after the second shut-off valve 31 is closed and the pressure in the cylinders 8 is raised to the selected preset level. When the limit switch 27*a* is turned on at the upper stroke end A, the signal of the pressure switch 34 is made effective, so that the press is stopped if the pressure in the cylinders 8 is abnormally lowered below the lower limit while the die 1 is moved down to the lower stroke end B and moved up to the position F. Thus, troubles with the cushioning apparatus due to the abnormal drop of the pressure in the cylinders 8 are prevented by the pressure switch 34.

The present second embodiment has not only the advantage as described above with respect to the function of the first shut-off valve 25, but also the following advantage.

While the die 1 is moved upward from the position F to the position G, the second shut-off valve 31 is held open, permitting the fluid in the cylinders 8 to flow toward the reservoir 20*a*, and causing the fluid to be fed from the power supply 20 to the cylinders 8, so as to re-adjust the pressure in the cylinders 8 at the selected preset level. Thus, the pressure in the cylinders 8 is set to the preset level each time the pressing cycle is initiated, or a short time before the die 1 is located at the upper stroke end A.

The above arrangement prevents a rise in the pressure in the cylinders 8 above the preset level at the start of each pressing cycle, even if the pressure in the cylinders 8 were raised above the preset level during the pressing cycle due to a high ambient temperature or dissipation of heat from the die assembly. That is, the preset pressure level is established a short time before each pressing cycle is initiated.

The present second embodiment using the first and second shut-off valves 25, 31 is capable of maintaining the pressure in the cylinders 8 at the preset level at the beginning of each pressing cycle, by avoiding the so-called "pumping action" due to the impact force upon collision of the upper movable die 1 against the workpiece W, and by establishing the preset pressure in the cylinders 8 before initiation of each pressing cycle so as to eliminate a rise of the temperature of the cylinders 8 due to the heat generated by the die assembly.

As described above, the second embodiment of FIG. 2 is preferred in view of the function of the second shut-off valve 31 in addition to the first shut-off valve 25, and is desirable to avoid the deterioration of the cushioning function of the cylinders 8, which would cause wrinkling, cracking or deformation of the products obtained by the press, and fluid leakage from and damage of the cylinders 8.

While the present invention has been described above in its presently preferred embodiments, it is to be understood that the invention is not limited to the details of the illustrated embodiments, but may be embodied with various changes, modifications and improvements, which may occur to those skilled in the art, in the light of the foregoing teachings.

For example, the solenoid-operated two-port two-position shut-off valves 25, 31 may be replaced by other types of valves, which may be mechanically operated or hydraulically or pneumatically operated, provided the valves used are operable between two positions which permit and inhibit the flows of the fluid through the respective first and second fluid passages 17, 30.

Although the contact-type position sensing means in the form of the limit switches 27*a*, 27*b*, or limit switches 27*a*, 27*b*, 33*a*, 33*b* is used to detect the appropriate positions of the movable die 1, these limit switches may be replaced by other sensing means such as optical sensors or other non-contact type position sensing means. The position sensing means may be adapted to detect the positions of the movable die 1 by indirectly detecting the angular positions of the crankshaft which is mechanically linked with the die 1.

Further, the positions of the movable die 1 may be detected or determined by measuring the time lapses after the initiation of each pressing cycle, which time lapses correspond to the positions D, B, F and G of the die 1 or crankshaft. In this case, a suitable timer may be considered to be the position sensing means for detecting the positions of the movable die 1.

It is to be understood that various other changes, modifications and improvements may be made in the present invention, without departing from the spirit and scope of the invention defined in the following claims.

What is claimed is:

1. A hydraulic cushioning apparatus for a press having a movable die, comprising a pressure pin associated with a workpiece, a hydraulic cylinder linked with said pressure pin, a cushioning device linked with said hydraulic cylinder, a hydraulic power supply for supplying a pressurized fluid at a preset pressure level to said hydraulic cylinder, and fluid passage means for hydraulically connecting said hydraulic power supply and said hydraulic cylinder, said apparatus comprising:

a check valve disposed in said fluid passage means, said check valve permitting a flow of said pressurized fluid from said hydraulic power supply to said hydraulic cylinder;

a shut-off valve disposed in said fluid passage means, in series connection with said check valve, and having an open position and a closed position for connection and disconnection of said hydraulic power supply to and from said hydraulic cylinder, respectively; and control means connected to said shut-off valve, for controlling said shut-off valve such that said shut-off valve is operated from said open position to said closed position to inhibit a flow of the fluid from said hydraulic power supply into said hydraulic cylinder before said movable die comes into pressing contact with said workpiece, and is held in said closed position for at least a period until a fluid pressure in said hydraulic cylinder rises to said preset pressure level.

2. A hydraulic cushioning apparatus for a press having a movable die, comprising a pressure pin associated with a workpiece, a hydraulic cylinder linked with said pressure pin, a cushioning device linked with said hydraulic cylinder, a hydraulic power supply for supplying a pressurized fluid at a preset pressure level to said hydraulic cylinder, and fluid passage means for hydraulically connecting said hydraulic power supply and said hydraulic cylinder, said apparatus comprising:

a check valve disposed in said fluid passage means, said check valve permitting a flow of said pressurized fluid from said hydraulic power supply to said hydraulic cylinder;

a shut-off valve disposed in said fluid passage means, in series connection with said check valve, and having an open position and a closed position for connection and disconnection of said hydraulic power supply to and from said hydraulic cylinder, respectively; and control means connected to said shut-off valve, for controlling said shut-off valve such that said shut-off valve is operated from said open position to said closed position to inhibit a flow of the fluid from said hydraulic power supply into said hydraulic cylinder before said movable die comes into pressing contact with said workpiece, and is held in said closed position for at least a period until a fluid pressure in said hydraulic cylinder rises to said preset pressure level, thereby preventing an increase in the fluid pressure in said hydraulic cylinder above said preset level due to a flow of the fluid into said hydraulic cylinder when said fluid pressure is lower than said preset level.

3. A hydraulic cushioning apparatus according to claim 2, wherein said control means comprises a controller for commanding said shut-off valve to be operated selectively to said open and closed positions, and position sensing means for detecting a first position of said movable die at which said shut-off valve is operated to said closed position, and a second position of said movable die at which said shut-off valve is operated to said open position, said position sensing means being connected to said controller to operate said shut-off valve to said closed and open positions, when said first and second positions are detected by said position sensing means, respectively.

4. A hydraulic cushioning apparatus according to claim 3, wherein said position sensing means comprises a first and a second contact-type detector disposed on a path of a reciprocating movement of said movable die.

5. A hydraulic cushioning apparatus according to claim 2, wherein said control means operates said shut-off valve to said open position when said movable die has reached a lower stroke end during each pressing cycle in which said movable die is reciprocated between an upper stroke end and said lower stroke end.

6. A hydraulic cushioning apparatus according to claim 2, wherein said hydraulic power supply comprises a hydraulic pressure source, and pressure setting means for establishing said preset pressure level.

7. A hydraulic cushioning apparatus according to claim 6, wherein said pressure setting means includes means for selecting as said preset pressure level one of a plurality of pressure levels.

8. A hydraulic cushioning apparatus according to claim 1, wherein said first shut-off valve includes a solenoid-operated valve electrically connected to said control means.

9. A hydraulic cushioning apparatus for a press having a movable die, comprising a pressure pin associated with a workpiece, a hydraulic cylinder linked with said pressure pin, a cushioning device linked with said hydraulic cylinder, a hydraulic power supply including a reservoir and a hydraulic pressure source for supplying a pressurized fluid of a preset pressure level to said hydraulic cylinder, and fluid passage means for hydraulically connecting said hydraulic power supply and said hydraulic cylinder, said fluid passage means including a first fluid passage which connects said hydraulic pressure source and said hydraulic cylinder, and a second fluid passage which connects said first fluid passage to said reservoir, said apparatus comprising:

a first shut-off valve disposed in said first fluid passage means and having an open position and a closed position for connection and disconnection of said hydraulic power supply to and from said hydraulic cylinders, respectively;

a second shut-off valve disposed in said second fluid passage; and control means connected to said first and second shut-off valve, for controlling said first shut-off valve such that said first shut-off valve is operated from said open position to said closed position before said movable die comes into pressing contact with said workpiece, and held in said closed position for at least a period until a pressure of said fluid in said hydraulic cylinders rises to said preset pressure level, and for controlling said second shut-off valve such that said second shut-off valve is opened after said movable die has started an upward stroke from a lower stroke and during each pressing cycle in which said movable die is reciprocated between an end of said upward stroke and an end of said lower stroke, said control means holding said second shut-off valve open for a period which expires before said first shut-off valve is operated to said closed position.

10. A hydraulic cushioning apparatus according to claim 9, wherein said control means comprises a controller for controlling said first and second shut-off valves, and position sensing means for detecting a first position of said movable die at which said second shut-off valve is opened, and a second position at which said period expires and said second shut-off valve is closed, said controller commanding said second shut-off valve to be opened and closed when said first and second positions are detected by said position sensing means, respectively.

11. A hydraulic cushioning apparatus according to claim 10, wherein said position sensing means comprises a first and a second contact-type detector disposed on a path of a reciprocating movement of said movable die.

12. A hydraulic cushioning apparatus according to claim 9, wherein said control means commands said second shut-off valve to close before said movable die reaches said end of said upward stroke.

13. A hydraulic cushioning apparatus according to claim 9, wherein said first shut-off valve includes a solenoid-operated valve electrically connected to said control means.

* * * * *